United States Patent [19]

Wilde

[11] Patent Number: 5,009,214

[45] Date of Patent: Apr. 23, 1991

[54] HOLDING AND RELEASE MECHANISM

[76] Inventor: James Wilde, 2022 Stephens Rd., Prudenville, Mich. 48651

[21] Appl. No.: 427,555

[22] Filed: Oct. 27, 1989

[51] Int. Cl.[5] ..... F41B 5/00; A01K 27/00

[52] U.S. Cl. ..... 124/35.2; 119/96

[58] Field of Search ..... 124/31, 35 A, 35 R; 119/96

[56] References Cited

U.S. PATENT DOCUMENTS

| | | | |
|---|---|---|---|
| 2,819,707 | 1/1958 | Kayfes et al. | 124/35 |
| 3,099,250 | 7/1963 | Soles, Jr. | 119/114 |
| 3,749,076 | 7/1973 | Suski et al. | 124/31 |
| 4,062,339 | 12/1977 | Wilson | 124/35 |
| 4,132,215 | 1/1979 | Burton | 124/35 |
| 4,620,523 | 11/1986 | Peck | 124/35 A |
| 4,691,683 | 9/1987 | Peck | 124/35 A |
| 4,722,319 | 2/1988 | Brady | 124/35 A |
| 4,854,293 | 8/1989 | Roberts | 124/35 A |

OTHER PUBLICATIONS

Bowhunter, p. 64, Jan. 1990.

Bowhunting World, Jun. 1989, pp. 108–119.

*Primary Examiner*—Peter M. Cuomo

*Assistant Examiner*—John A. Ricci

[57] ABSTRACT

A holding and release mechanism for a flexible line or a rigid rod, particularly a bow string release mechanism for use in drawing a bow string back and releasing the same to propel an arrow to the target. The mechanism comprises dual yoke arms slotted to receive a flexible line or rigid rod to which are attached a swinging lever holding member having dual rod-like extensions extending perpendicular thereto. The line or rod is held by the rod-like extensions between the dual slotted yoke arms. The swinging lever is pivotally attached to the slotted yoke arms and is held by a retaining rod at the rearward extension thereof at a detent position. The retaining rod is urged out of the detent position by a trigger which moves the retaining rod rearwardly. The retaining rod is held in the detent position by a coiled spring under tension positioned on the circumference of the retaining rod. The trigger engages said rod and, upon actuation, moves said rod rearwardly out of the detent position thus releasing the swinging, lever holding member.

5 Claims, 3 Drawing Sheets

HOLDING AND RELEASE MECHANISM

BACKGROUND OF THE INVENTION

1. Field of the Invention

This invention relates to holding and release mechanisms, particularly a holding and release mechanism for a bow string.

2. Description of the Prior Art

Quick release mechanisms such as those intended to quickly release an animal leash are known. In U.S. Pat. No. 3,099,250 to Soles, Jr., one end of a quick release mechanism can be held by the dog handler and the other end can be attached to the animal dog collar.

Many bow string quick release devices intended for use in archery and in bow hunting have appeared over the years. Some of the most important and desirable features necessary in such mechanisms have been overlooked. This invention provides a new and reliable releasing mechanism which is compact, light in weight, easy to attach to a flexible line, such as a bow string, or a rigid rod, such as can be attached to a dog collar. The quick release mechanism of the invention can be used in either hand and, when used as a bow string release, allows an arrow to be centered on either side of rod-like bow string holding pins, thus avoiding the disadvantages of the more conventional release mechanisms which require positioning the arrow above the release and holding mechanism.

In U.S. Pat. No. 4,132,215 to Burton and U.S. Pat. No. 4,062,339 to Wilson, there are disclosed bow string holding and release mechanisms in which the holding and release mechanism is positioned directly below the position of the arrow on the bow string. As is well known in the art, arrows are usually fitted with a nock prior to insertion of the arrow on the bow string. The nock fits over the blunt end of the arrow so as to hold it firmly in position and is slotted so as to receive the bow string. A particularly annoying problem, associated with bow string holding and release mechanisms in which the arrow and the nock are positioned directly above the holding and release mechanism, is that the angle of the bow string when drawn tends to put uneven pressure on the slotted area of the nock, sometimes causing breakage of the nock. Generally, this position of the arrow results in resistance to the rearward movement associated with drawing the bow string but, most importantly, this position of the arrow interferes with the accurate trajectory of the arrow upon release of the bow string holding mechanism.

In U.S. Pat. No. 3,749,076 to Suski et al, a bow string holding and release mechanism is described in which the arrow and nock, instead of being positioned above the release mechanism, as described in the above references, is held at the apex of the angle formed by the drawn bow string. This is accomplished by utilizing a nock of special design which is slotted as usual to receive the bow string but is additionally grooved and adapted to fit within a blind bored portion of the holding mechanism which is in turn itself slotted to receive a detent which is adapted to engage the slotted portion of the nock, thus holding it in position.

In U.S. Pat. No. 2,819,707 to Kayfes et al, another mechanism is disclosed for holding an arrow and nock in a bow string holding and releasing mechanism at the apex of the angle formed by the drawn bow string. In this mechanism, the bow string is held on either side of the nock and arrow by two jaws which pivot on mounting pins and are spring biased so as to force the jaws apart. Upon release of a detent mechanism at the opposite end of the jaws, the jaws open.

SUMMARY OF THE INVENTION

A holding and release mechanism is disclosed which is particularly adapted to the holding and release of a bow string associated with an arrow. In the mechanism of the invention, dual yoke arms, slotted at the open ends thereof to receive a bow string, coact with a swinging holding lever, positioned between said yoke arms, having dual rod-like extensions extending perpendicular to the plane of said swinging lever. Said swinging lever is pivotally attached to each of the yoke arms and is frictionally held in the bow string holding position by a detent portion thereof which frictionally engages a rod mounted at the closed ends of the yoke arms. Upon actuation of a trigger, the rod is moved rearwardly out of a detent position in which the swinging lever is held when the mechanism is in a holding mode.

BRIEF DESCRIPTION OF THE DRAWINGS

FIG. 4 is partly in vertical cross section and shows the attachment of the arrow to the bow string and the retaining rod attachment at a detent position in which the bow string is held by the device.

DETAILED DESCRIPTION OF THE DRAWINGS AND THE PREFERRED EMBODIMENTS

Figure 1:
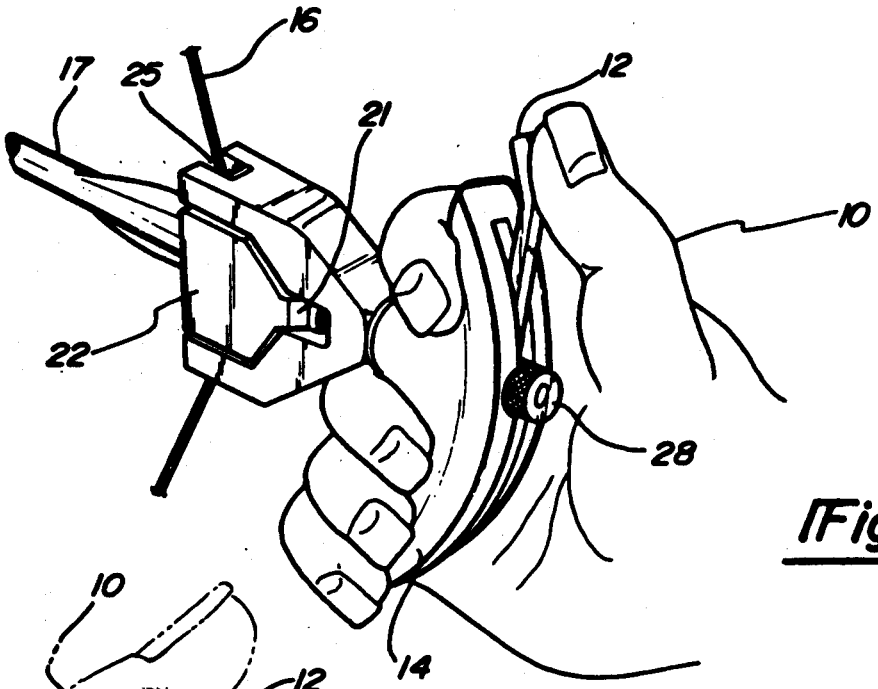
FIG. 1 is a perspective view of the hand of an archer supporting a bow string and arrow with the bow string held in a drawn position by means of the holding and release mechanism of the invention.
Figure 2:
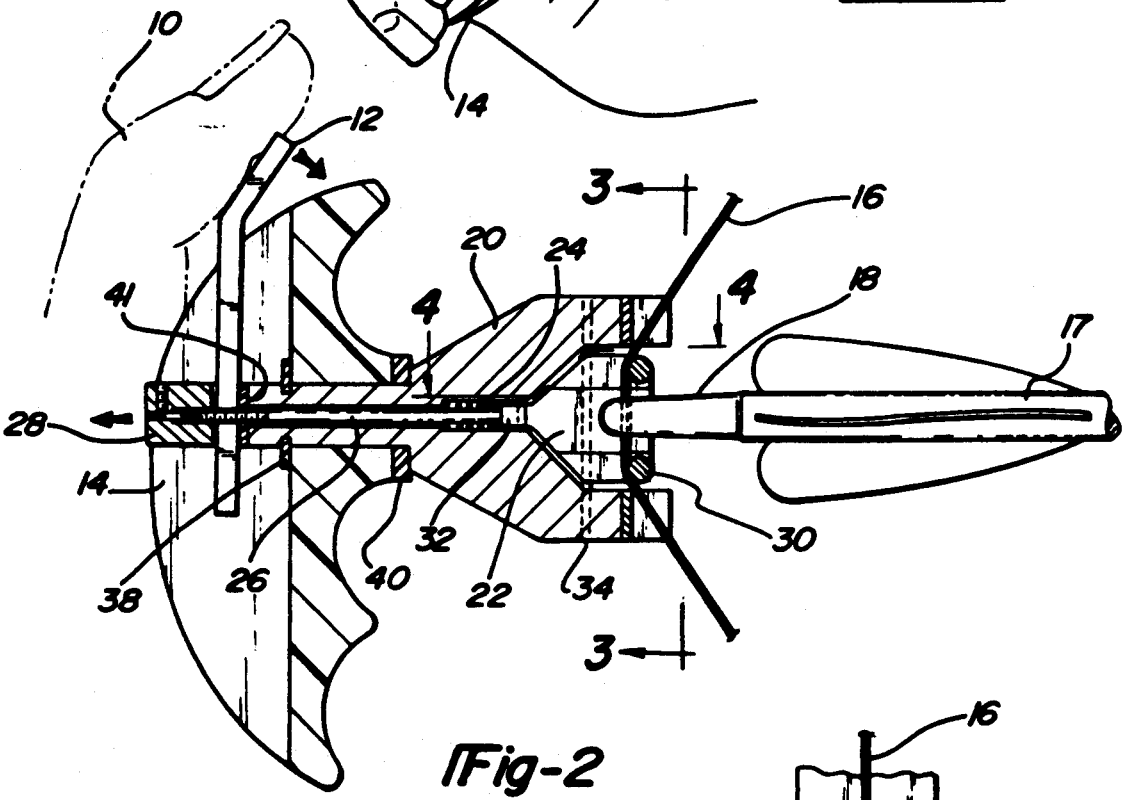
FIG. 2 is a vertical cross section view taken substantially upon a plane passing through the center of the holding and release mechanism of the invention.
Figure 4:
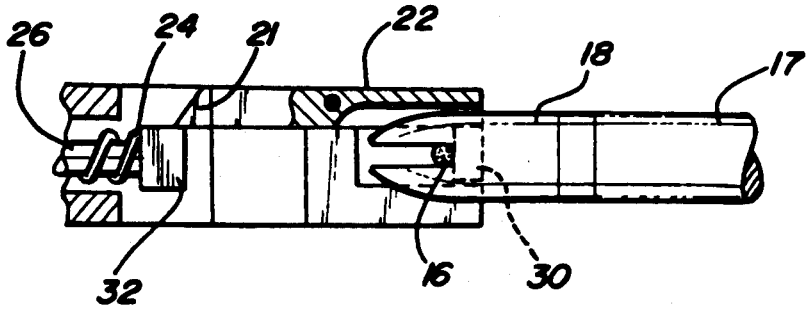
FIG. 4 is a fragmentary plan view of the device taken substantially on the planes of lines 4—4 of FIG. 2.
Figure 5:
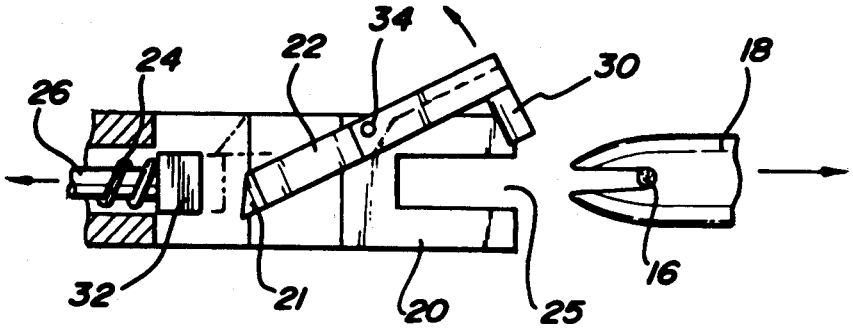
FIG. 5 is a fragmentary plan view of the device, similar to FIG. 4, except that the device is shown in the released position.
Figure 6:
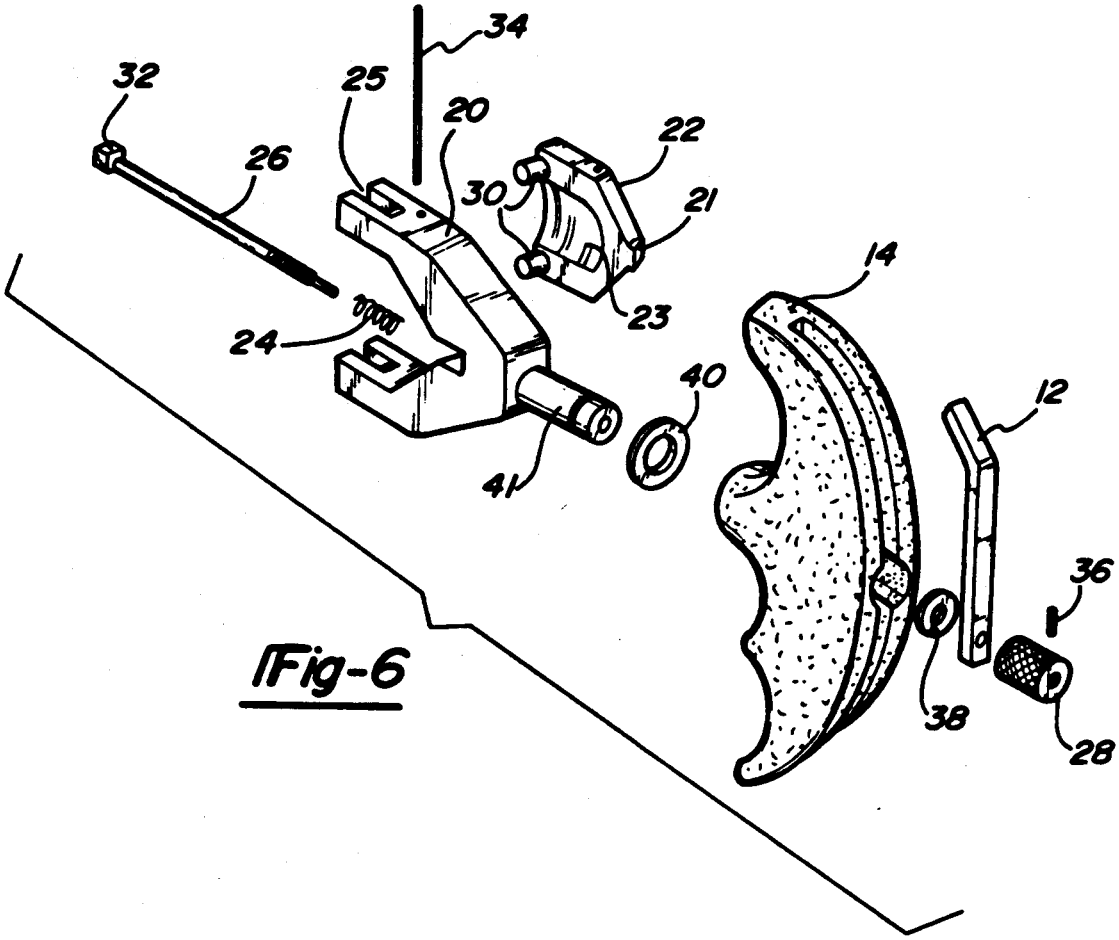
FIG. 6 is an exploded view of the device of FIG. 2.
Figure 7:
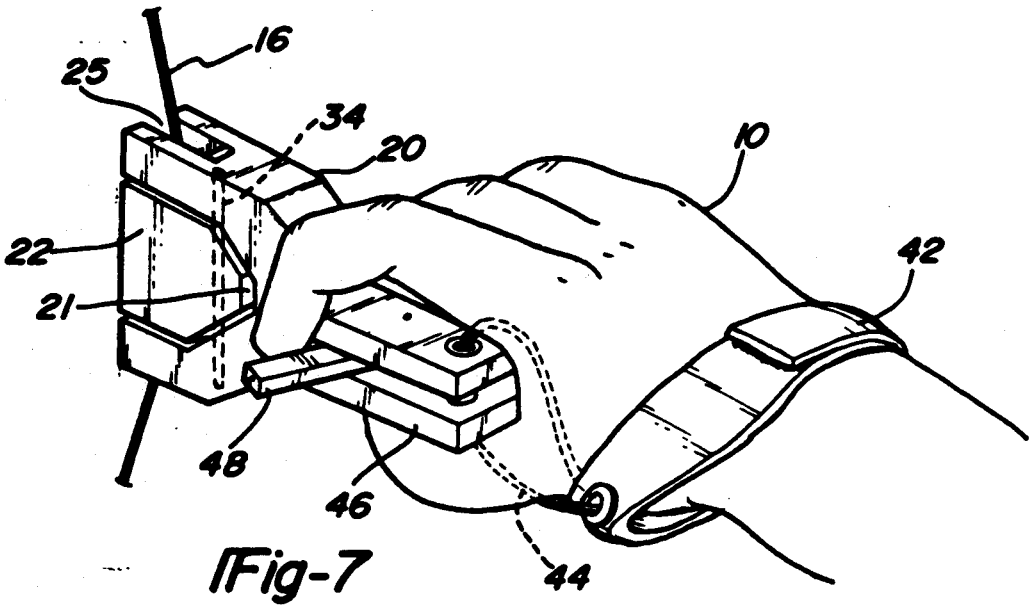
FIG. 7 is a perspective view of the hand of an archer, the bow string being supported by a wrist strap. The arrow and the bow string are held in a drawn position by means of the holding and release mechanism of the invention.

Referring now to the drawings, FIGS. 1-9, the numeral 10 generally designates the hand of an archer holding the hand grip portion 14 of the device shown in FIGS. 1, 2, and 6 and the archer's hand 10 around the wrist of which is placed a wrist strap 42, as shown in FIG. 7.

One embodiment of the holding and releasing mechanism of the invention, as shown in FIGS. 2-6, includes a hand grip 14 to which is attached trigger 12 and trigger adjusting knurled nut 28. The hand grip 14 is rotatably attached to dual yoke members 20, the outer ends of which are slotted to receive bow string 16. A swinging holding member 22, which is adapted to receive a nock retained on the blunt end of an arrow, is pivotally attached to the dual yoke member 20 and tapers toward the rear thereof to include a detent portion 21 and at the forward end of said swinging holding member dual rodlike extensions project perpendicular to the plane of said member 22 and are integrally attached thereto. Swinging holding member 22 is concavely shaped at the central portion 23 thereof so as to receive nock 18, which is in turn attached to arrow 17.

Referring now to FIG. 2 swinging holding member 22 is shown to be pivotably attached to dual yoke arms 20 by pin 34. Detent 32 is shown frictionally contacting the rearward portion of swinging holding member 22. Coil spring 24 is shown as being placed circumferentially around rod 26 so that said rod 26 is urged forward into a detent position by spring 24. Washer 40 separates gripping member 14, having 360° movement, from the dual yoke member 20. Washer 38 is positioned adjacent to trigger 12 which releases the swinging holding member by rearwardly moving rod 26 so as to release detent 32 holding the rearward portion of swinging holding member 22, thus allowing said swinging holding member to pivot and release the bow string 16. A knurled nut 28 is threaded onto rod 26 to provide adjustment of trigger lever 12, which is actuated by pushing the lever forward.

Figure 3:
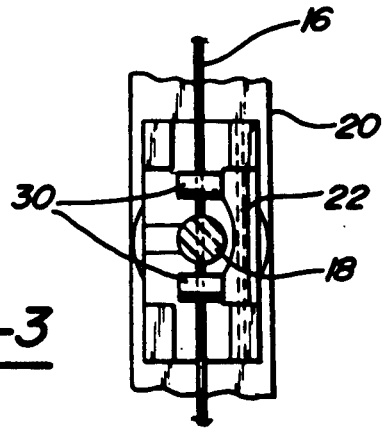
FIG. 3 is a front elevational view of the device illustrated in FIG. 2 and is taken substantially on the plane of line 3—3 of FIG. 2.

In FIG. 3, there is shown a bow string 16 and nock 18 in position between the slotted yoke arms 20, said bow string 16 held in place by dual rodlike extensions 30 attached integrally perpendicular to the plane of swinging holding member 22.

In FIG. 4, rod 26 and spring 24, attached circumferentially around said rod, are shown together with the detent portion 32 of rod 26, wherein the mechanism is shown in a holding mode.

In FIG. 5, the mechanism of FIG. 4 is shown in a release mode in which the detent portion 32 of rod 26 is moved rearward so as to release the swinging holding member 22 having rodlike extensions 30 for holding the bow string, said swinging holding member 22 being pivotably attached to yoke arm 20 by rod 34. The various parts of the mechanism of this embodiment of the invention are shown more clearly in the exploded view of FIG. 6.

In a second embodiment of the holding and release mechanism of the invention, there is shown in FIG. 7 the attachment of the holding mechanism to the wrist of an archer's hand 10 by a strap 42 and cord 44 attached to dual yoke arms 20 by a rearward extension 46. A trigger 48, upon actuation, releases a bow string 16 held by swinging holding member 22, which is pivotably attached to said dual yoke arms 20 by rod 34.

Figure 8:
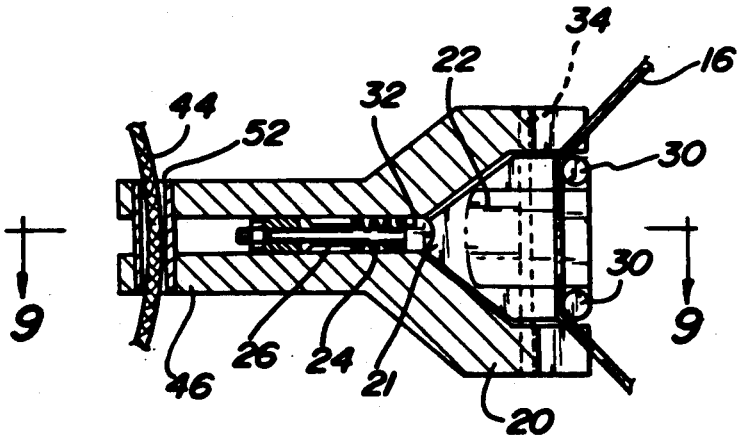
FIG. 8 is a vertical cross sectional view of the device illustrated FIG. 7.

In FIG. 8, showing a cross sectional view of the mechanism of FIG. 7, taken along the vertical center thereof, bow string 16 is shown held by rodlike extensions 30 integrally attached to swinging holding member 22. The rearward portion of swinging holding member 22 is frictionally held by the detent 32 which forms the forward end of rod 26 around the circumference of which spring 24 is placed in compression. Upon release of trigger 48, spring 24 urges rod 26 forwardly so as to allow detent portion thereof 32 to engage the rearward portion of swinging holding member 22, thus placing the mechanism is a holding mode.

Figure 9:
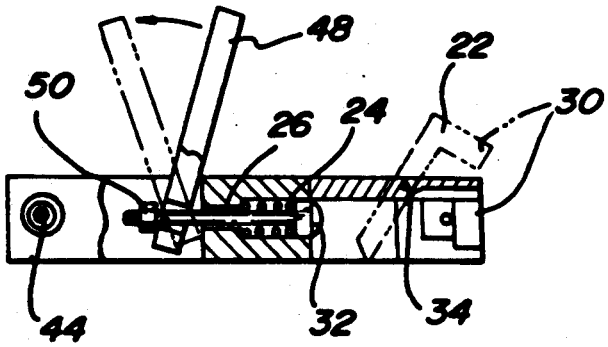
FIG. 9 is a horizontal cross sectional view of the device illustrated in FIG. 8 and is taken substantially on the plane of line 9—9 of FIG. 8.

In FIG. 9 showing a sectional view taken along line 9—9 of FIG. 8, the mechanism is shown in a release mode in which swinging holding member 22 is shown pivoting upon rod 34 in a release position. The release position occurs upon actuation of trigger 48 to move rearward rod 26 which is secured against trigger 48 by adjusting nut 50 which is fitted with a set screw, not shown.

OPERATION OF THE DEVICE

To attach either of the disclosed embodiments of the holding and release mechanism of the invention to a bow string, it is necessary that the mechanism be in a released position. To accomplish this, the trigger is actuated and such action forces a retaining rod 26 rearward from its engaging position at the rear portion of swinging holding member 22, thus allowing the swinging holding member 22 to freely pivot on its attachment rod 34. A bow string 16, is then placed within the slotted portions 25 of each yoke arm 20 and the swinging holding member 22 is moved into position so that the rearward portion thereof contacts the retaining rod 26 at the detent end 32 thereof. An arrow fitted with a nock 18 is now placed against the retained bow string 16 and the bow string 16 drawn to a desired tension. A hand grip 14 can be used to grip the device. Alternatively, a wrist strap 42 can be used on another embodiment of the device. When the user is satisfied that his aim is proper, he actuates the trigger 12 or 48 with his thumb or index finger, thus releasing from the detent position the swinging holding member 22, allowing it to pivot on rod 34, which is attached on the dual yoke arms 20, and releasing the bow string.

When the holding and release device of the invention is utilized in connection with a leash for an animal, such as a quick release mechanism for holding and retaining, for instance, a dog, the leash line, or alternatively, a rigid rod or line made integral with an animal collar can be placed within the slotted yoke arms 20 of the device in a manner similar to attaching and retaining a bow string, as described above. The device is then moved from the release position to the holding position. Rapid release of the animal leash is accomplished simply by actuating the trigger member 12 to place the device in the release position. Actuation of the trigger in turn moves the retaining rod 26 rearwardly so as to move the swinging holding member 22 out of the detent position thus allowing the swinging member to freely move so as to release the leash line, or rod integral with the animal collar and allow the animal to run free.

Although only certain embodiments of the invention have been shown and described herein, it will be apparent to those skilled in the art that various changes and modifications can be made herein without departing from the spirit and scope of the invention and such changes and modifications are intended to be covered by the appended claims.

The embodiments of the invention in which an exclusive property or privilege is claimed are defined as follows:

1. A holding and release mechanism comprising

A. dual yoke arms, said arms having slotted open ends to receive a flexible line or rigid rod;

B a swinging lever holding member attached between said yoke arms, said lever having dual rod-like extensions attached perpendicular to the plane of said lever and adapted to hold said line or rod within said slotted open ends of said yoke arms, said swinging lever holding member being attached to said yoke arms so as to allow said swinging lever to pivot between said yoke arms, and said swinging lever extending rearwardly so as to form a detent portion thereof;

C. a retaining rod slidably positioned in a bore formed in the closed ends of said yoke arms, said rod being urged forwardly by a coil spring engaging said rod on the circumference thereof, having a detent on the forward end thereof, and adapted to frictionally engage said detent portion of said holding member; and D. a trigger acting upon said retaining rod so as to move said rod rearwardly and out of a detent position in which said swinging lever holding member is held in a detent position so as to retain said line or rod within said slotted portion of said yoke arms.

2. The article recited in claim 1 wherein said swinging lever holding member is adapted to receive a nock retained on the blunt end of an arrow, said arrow being positioned between said yoke arms, said line being a bow string passing through the slotted portions of said yoke arms and through a slot on said nock wherein upon actuation of said trigger, said rod is rearwardly moved out of engagement at a detent position on said swinging lever holding member so that said swinging lever holding member is allowed to pivot, thus releasing said bow string.

3. The article of claim 2 taken in combination with a rotatably attached handle means shaped to fit the user's hand or a wrist strap, each mounted on said holding and release mechanism.

4. The article of claim 3 wherein said handle is attached to said yoke arms so as to allow 360° movement thereof in order to allow manual adjustment of said holding and releasing mechanism to permit use of said mechanism by either right or left hand.

5. The article recited in claim 1 wherein said swinging holding member is adapted to receive a flexible line or rigid rod attached to an animal collar.

* * * * *